US006808002B2

(12) United States Patent
Colson et al.

(10) Patent No.: US 6,808,002 B2
(45) Date of Patent: Oct. 26, 2004

(54) BALANCED TILT MECHANISM FOR A COVERING FOR AN ARCHITECTURAL OPENING

(75) Inventors: Wendell B. Colson, Weston, MA (US); Marek Jarosinski, Brighton, CO (US); David G. Lynch, Aurora, CO (US); Robert A. Null, Arvada, CO (US); Bogdan R. Ulatowski, Westminster, CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 0 days.

(21) Appl. No.: 10/439,406

(22) Filed: May 16, 2003

(65) Prior Publication Data

US 2004/0016518 A1 Jan. 29, 2004

Related U.S. Application Data

(60) Provisional application No. 60/381,587, filed on May 17, 2002.

(51) Int. Cl.[7] ..... E06B 9/38
(52) U.S. Cl. ..... 160/176.1 R
(58) Field of Search ..... 160/176.1 R, 177 R, 160/168.1 R, 172 R, 173 R, 178.1 R; 49/74.1, 89.1

(56) References Cited

U.S. PATENT DOCUMENTS

| | | | | | |
|---|---|---|---|---|---|
| 2,250,106 | A | * | 7/1941 | Lorentzen | 160/170 |
| 2,420,301 | A | * | 5/1947 | Cusumano | 160/170 |
| 2,687,770 | A | * | 8/1954 | Walker et al. | 160/176.1 R |
| 3,156,295 | A | * | 11/1964 | Vecchiarelli et al. | 160/175 |
| 5,553,653 | A | | 9/1996 | Rozon | 160/173 |
| 6,561,252 | B2 | * | 5/2003 | Anderson et al. | 160/176.1 R |
| 6,622,769 | B2 | * | 9/2003 | Judkins | 160/84.05 |
| 6,648,050 | B1 | * | 11/2003 | Toti | 160/170 |
| 2002/0079066 | A1 | | 6/2002 | Colson | 160/176.1 R |
| 2003/0015300 | A1 | | 1/2003 | Colson et al. | 160/168.1 R |

FOREIGN PATENT DOCUMENTS

| | | |
|---|---|---|
| WO | WO 02/06619 A1 | 1/2002 |
| WO | WO 03/008751 A1 | 1/2003 |

* cited by examiner

*Primary Examiner*—David Purol
(74) *Attorney, Agent, or Firm*—Dorsey & Whitney LLP

(57) ABSTRACT

A balanced tilt mechanism for use in a covering for an architectural opening includes an actuator cord having a weighted tassel that cooperates with a tapered bobbin in a tiltable headrail in the covering. A constant tension spring counterbalances the weighted actuator cord so the headrail can be easily tilted between open and opposite closed positions.

11 Claims, 16 Drawing Sheets

BALANCED TILT MECHANISM FOR A COVERING FOR AN ARCHITECTURAL OPENING

CROSS-REFERENCE TO RELATED APPLICATION

This application is a non-provisional application which claims priority to U.S. provisional application No. 60/381,587, filed May 17, 2002, which application is incorporated by reference herewith in its entirety.

BACKGROUND OF THE INVENTION

1. Field of the Invention

The present invention relates generally to tilt mechanisms for operating retractable coverings for architectural openings and more particularly to a counterbalanced system to facilitate the ease of operation.

2. Description of the Relevant Art

This invention relates generally to mechanisms for tilting the slats or vanes of a covering for an architectural opening, and more specifically to a counterbalanced mechanism for low effort tilting of the slats of a horizontal blind covering.

Conventional Venetian-style blinds typically comprise a fixed head rail that is mounted to a window frame or other architectural openings through mounting brackets located at the ends of the head rail. To tilt the horizontal slats of the conventional style Venetian blind, a wand hanging from the head rail is rotated. The wand is connected to a tilt mechanism located within the head rail. Rotation of the wand turns one or more gears of the tilt mechanism that in turn rotate a tilt rod that extends generally along the length of and is contained within the head rail.

At two or more locations along the head rail the tilt rod is operatively connected to the ends of a ladder tape. The ladder tape typically comprises two vertical cords that extend downwardly from the head rail: one in front of the slats; and one behind the slats. The lower ends of the ladder tape are typically connected to a weighted foot rail. The vertical cords of each ladder tape are connected by cross rungs that also act to cradle and support associated slats of the blind. When the tilt rod is rotated, one of the vertical cords of each ladder tape is pulled upwardly into the head rail while the other vertical cord is pulled downwardly by the weight of the foot rail as additional cord is fed from the head rail. Accordingly, the cross rungs are pivoted between horizontal and generally vertical orientations, thereby tilting the slats they are supporting.

The conventional tilt mechanism is typically limited to use in Venetian-style blinds having a stationary head rail, which can contain and support the tilt mechanism including the longitudinally extending tilt rod. Fixed head rails are generally not considered to be aesthetically pleasing. Accordingly, head rails are often covered with valances or in other situations stationary slats are adhesively secured to the head rail to give the impression that the slats of the blind assembly extend the entire length of the blind.

Although conventional tilt mechanisms are generally very effective, friction in the mechanisms can require a significant amount of effort to be expended by the user to tilt the slats. Further, to tilt the slats from one closed position all the way to the opposite closed position a significant number of turns of the tilt wand are often required (typically 6 or more). A certain level of hand dexterity is required to operate the small diameter wand (larger diameter wands would distract from the aesthetics of the blinds) and accordingly, certain persons, such as the elderly, may find the conventional tilt mechanisms difficult to operate.

BRIEF SUMMARY OF THE INVENTION

A balanced mechanism for the tilting of horizontal blinds incorporating a tiltable head rail along with a blind assembly incorporating the balanced tilt mechanism are described. The balanced tilt mechanism permits the slats (or vanes) of the horizontal blinds to be pivoted in either clockwise or counterclockwise directions with minimal effort by gently lifting or pulling on a weighted tassel hanging from the end of a tilt actuator cord.

DETAILED DESCRIPTION OF THE INVENTION

Figure 1:
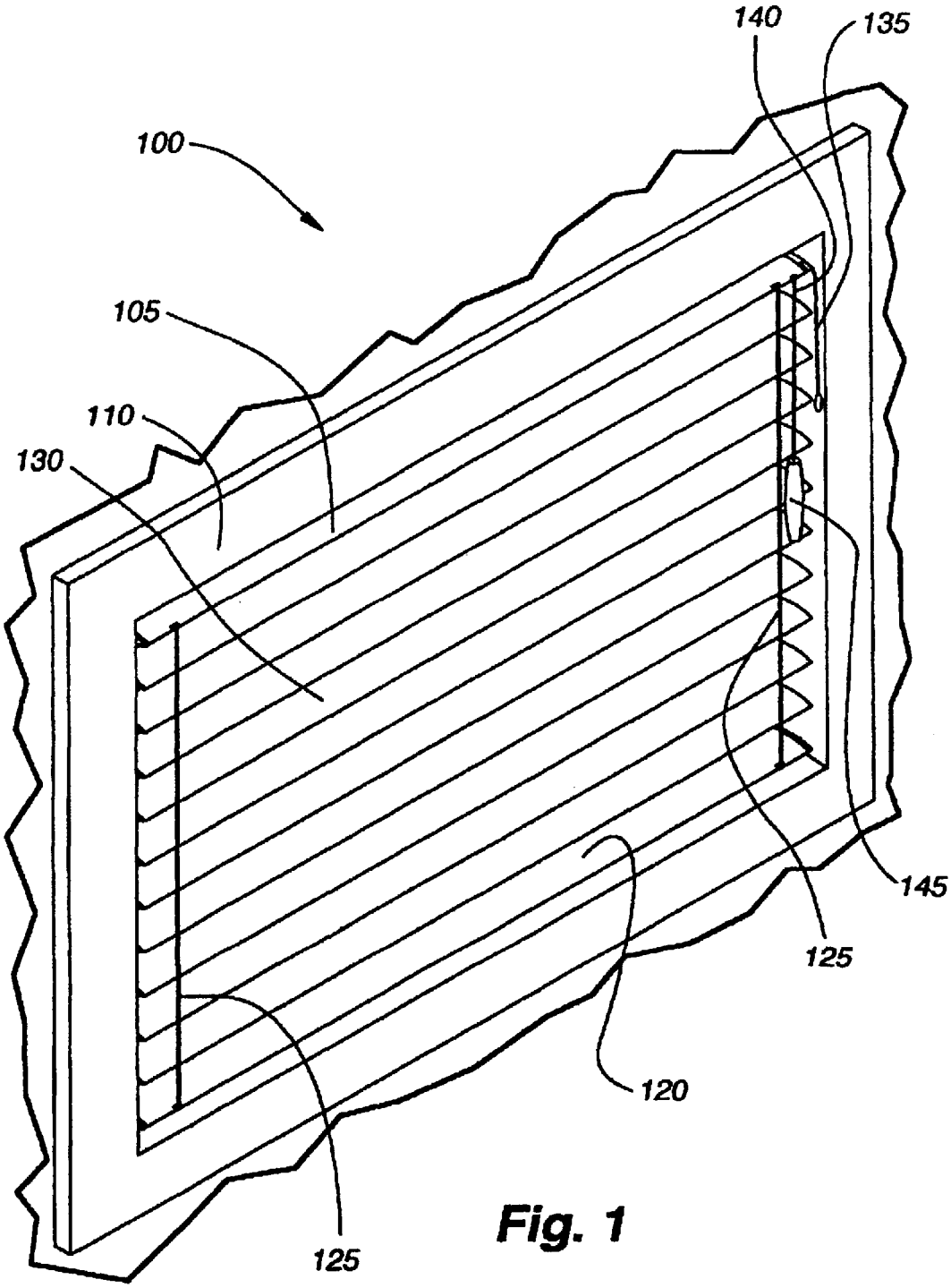
FIG. 1 is an isometric front view of a horizontal blind assembly incorporating a balanced tilt mechanism according to one embodiment of the present invention.

A balanced tilt mechanism and a blind assembly incorporating the balanced tilt mechanism are described. In a preferred embodiment of the balanced tilt mechanism, a weight hanging off the end of a tilt actuator cord applying a downwardly biasing force is balanced against a spring located within the head rail that applies a contravening upwardly biasing force to the tilt actuating cord. The cord is wrapped around a bobbin that is operatively coupled to a tiltable head rail through one or more gears to permit the pivoting of the head rail about rotational shafts associated with mounting brackets. Operationally, the balance is upset by gently pushing or pulling up or down on the tilt actuator cord, thereby causing the cord to retract or extend and the head rail to tilt accordingly. It is to be appreciated that because the mechanism is balanced very little effort is required to tilt the blinds.

The Blind Assembly

Referring to FIGS. 1–6, one embodiment of a window blind assembly 100 incorporating the balanced tilt mechanism is illustrated. While the present invention will be described for use as a window blind, it will be appreciated that a substantially similar blind assembly could be utilized with any architectural opening, such as doorways, archways and the like. The blind assembly 100 comprises: (i) a horizontally-extending slat-shaped rigid head rail 105 that is pivotally coupled to a window frame 110 by a pair of mounting brackets 115; (ii) a horizontally-extending somewhat rigid lower slat 120 coupled to the top slat by a plurality of lift cords (not shown) and ladder tapes 125; (iii) a plurality of horizontal slats 130 disposed between the head rail and the lower slat and coupled thereto by the ladder tapes; (iv) a lift actuator cord 135 for lifting and lowering the slats; and (v) a tilt actuator cord 140 including a weighted end tassel 145.

The illustrated blind assembly utilizes somewhat airfoil-shaped hollow slats, bottom slat and head rail. The construction of the slats and the blind assembly is described in greater detail in U.S. patent application Ser. No. 10/197,674 filed 16, Jul. 2002, and PCT Application No. PCT/US02/00225 filed Jul. 16, 2002, which are commonly owned by the Assignee of the present invention, and are hereby incorporated by reference in their entirety. Alternative configuration blind assemblies are anticipated as the slats can be in any suitable shape and fabricated from any suitable material. For instance, slats fabricated from plastic, fabric, metal and wood are contemplated. Further, the head rail can be of any number of shape configurations that are similar to or different from the associated slats. The lift mechanism can be of any suitable conventional type or it can be similar to the lift mechanisms described in the patents incorporated by reference and, as such, the lift mechanism will not be described in any greater detail herein.

Figure 3:
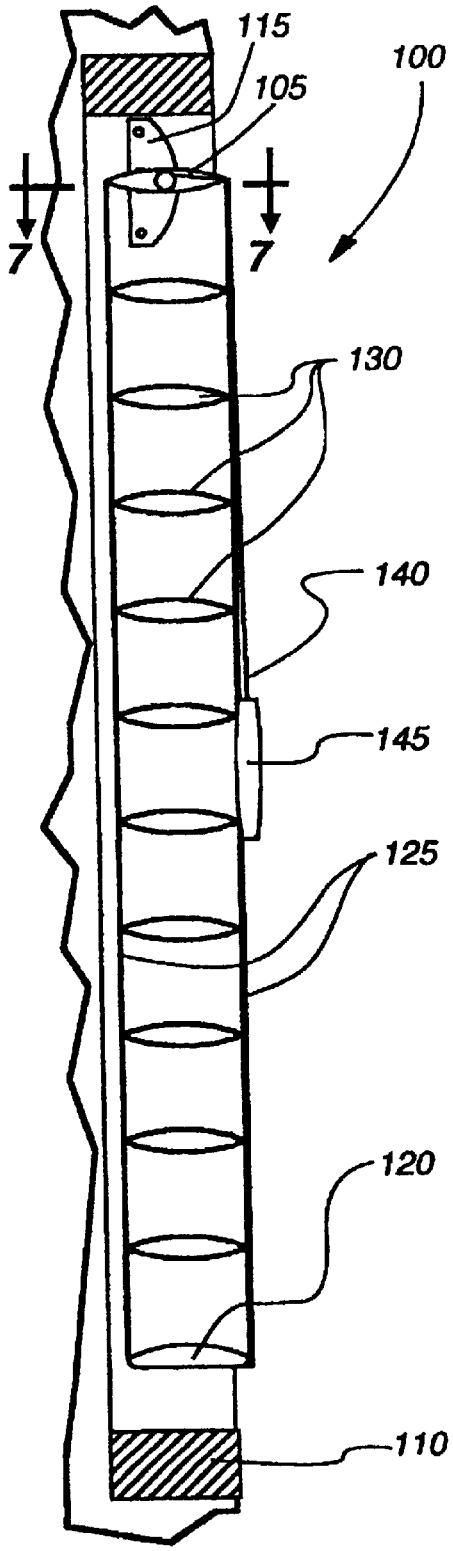
FIG. 3 is a cross sectional view of the horizontally blind assembly of FIG. 1 taken along line 3—3 of FIG. 2.
Figure 2:
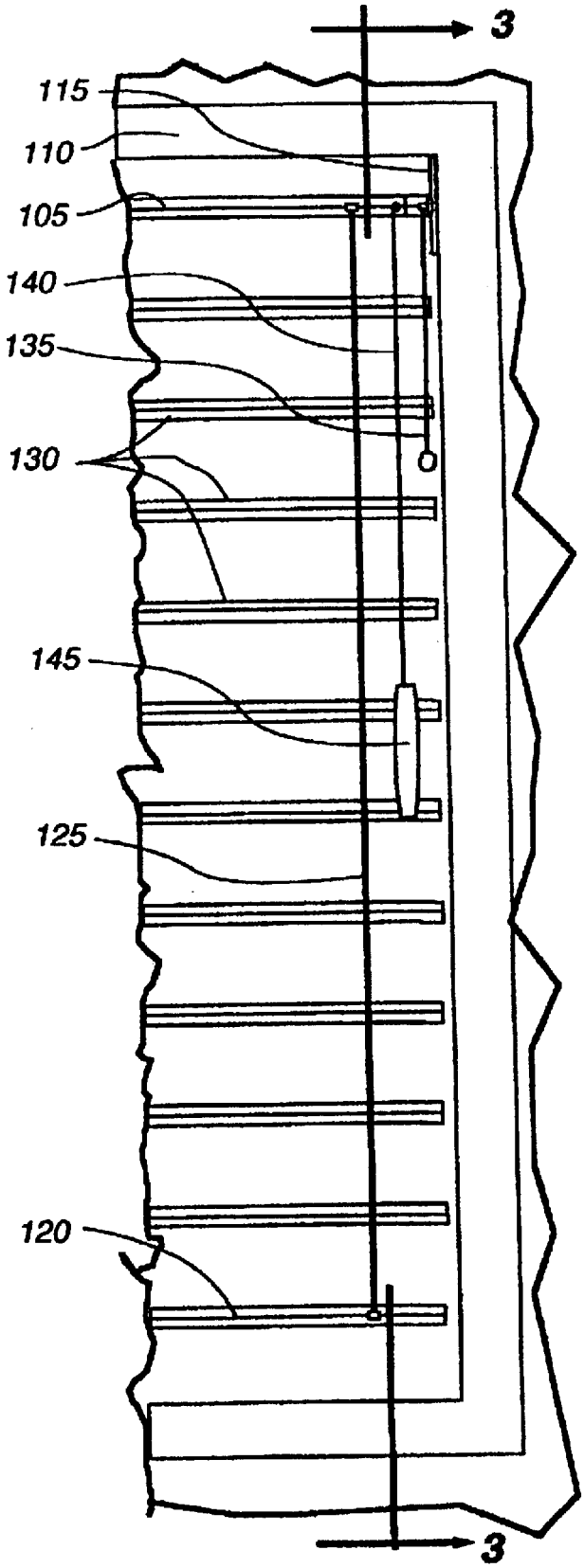
FIG. 2 is a partial front view of the horizontal blind assembly of FIG. 1 illustrating the weighted tassel on the end of the tilt actuating cord.
Figure 4:
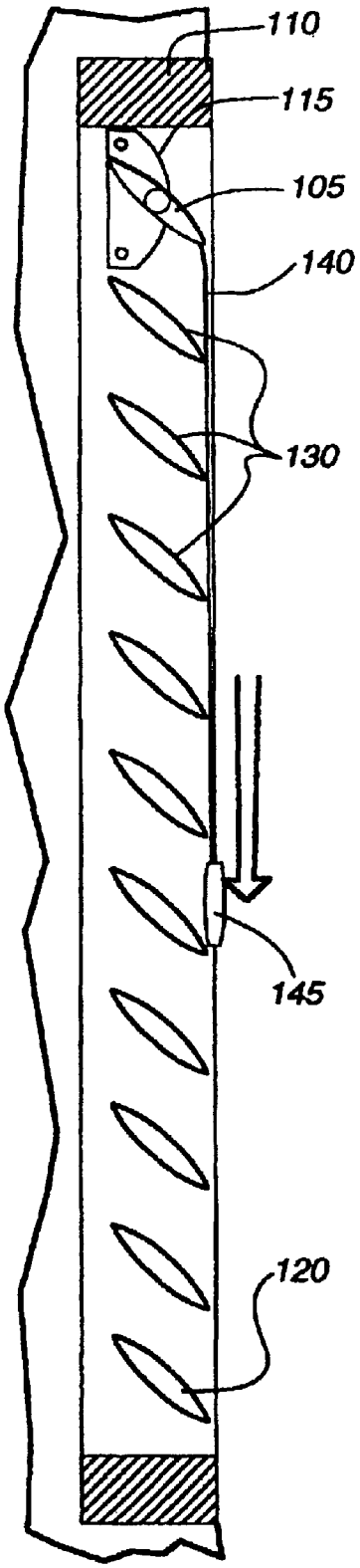
FIGS. 4–6 are cross sectional views of the horizontally extending blind assembly similar to the FIG. 3 view illustrating the slats (or vanes) in various tilt positions.

The ladder tapes 125 illustrated in FIGS. 1–3 typically comprise front and rear vertical cords that extend vertically across the front edges and rear edges respectively of the slats. Cross rungs (not specifically illustrated) span between each set of vertical cords at vertically-spaced locations to support and cradle the slats 130. In the preferred embodiment, the top end of each vertical cord is secured to one of the front edge and the rear edge of the head rail (as illustrated in FIG. 7), wherein the tops of the vertical cords are threaded through holes in the edges of the head rail and secured therein by a knot or an adhesive bead 150. Accordingly, when the head rail is tilted clockwise as shown in FIG. 4, the front vertical cord of each ladder tape 125 is lowered and the rear vertical cord of each ladder tape is raised, thereby causing the cross rungs to pivot clockwise along with the slats cradled in the cross rungs. Conversely, when the head rail is tilted counterclockwise as shown in FIG. 6, the front vertical cord of each ladder tape 125 is raised and the rear vertical cord of each ladder tape is lowered, thereby causing the cross rungs to pivot counterclockwise along with the slats cradled in the cross rungs.

Referring to FIG. 3, the blind assembly is illustrated with the slats in the fully open position. In this position the slats, head rail and foot rail are orientated substantially horizontally in their widthwise direction. The weighted tassel 145 attached to the end of the tilt actuator cord 140 is located at an intermediate vertical position that is easily reached by a user to move the slats into either a first or a second closed position.

Figure 5:
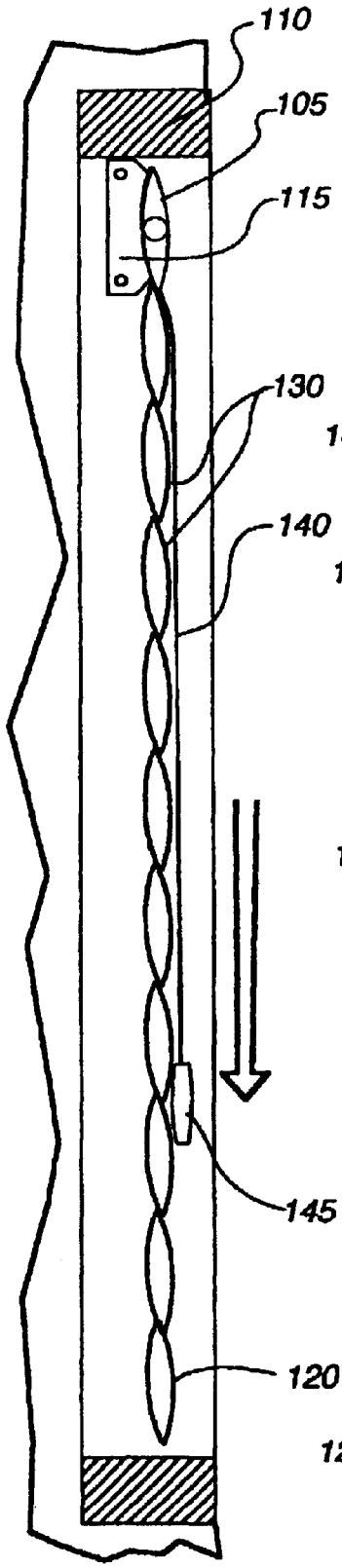
Figure 6:
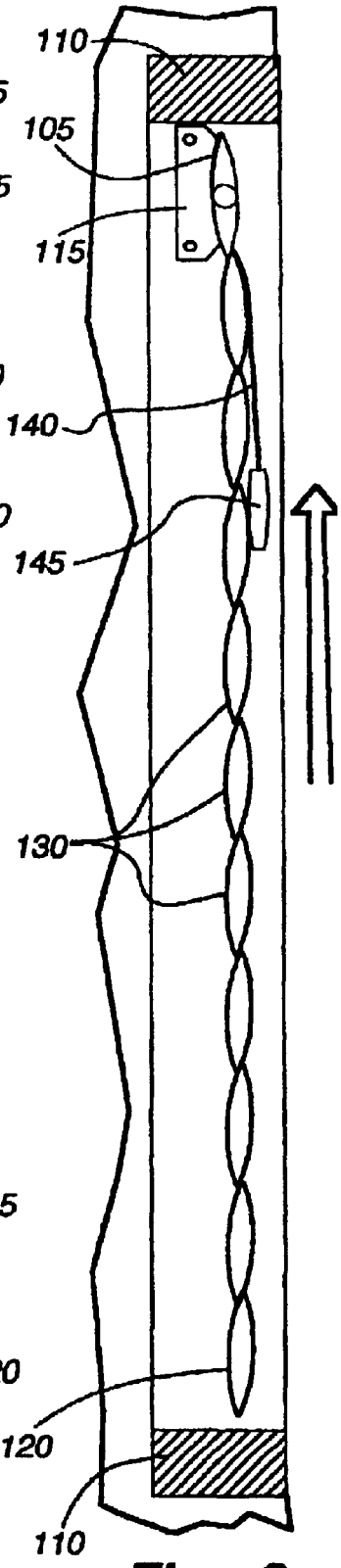
Figure 7:
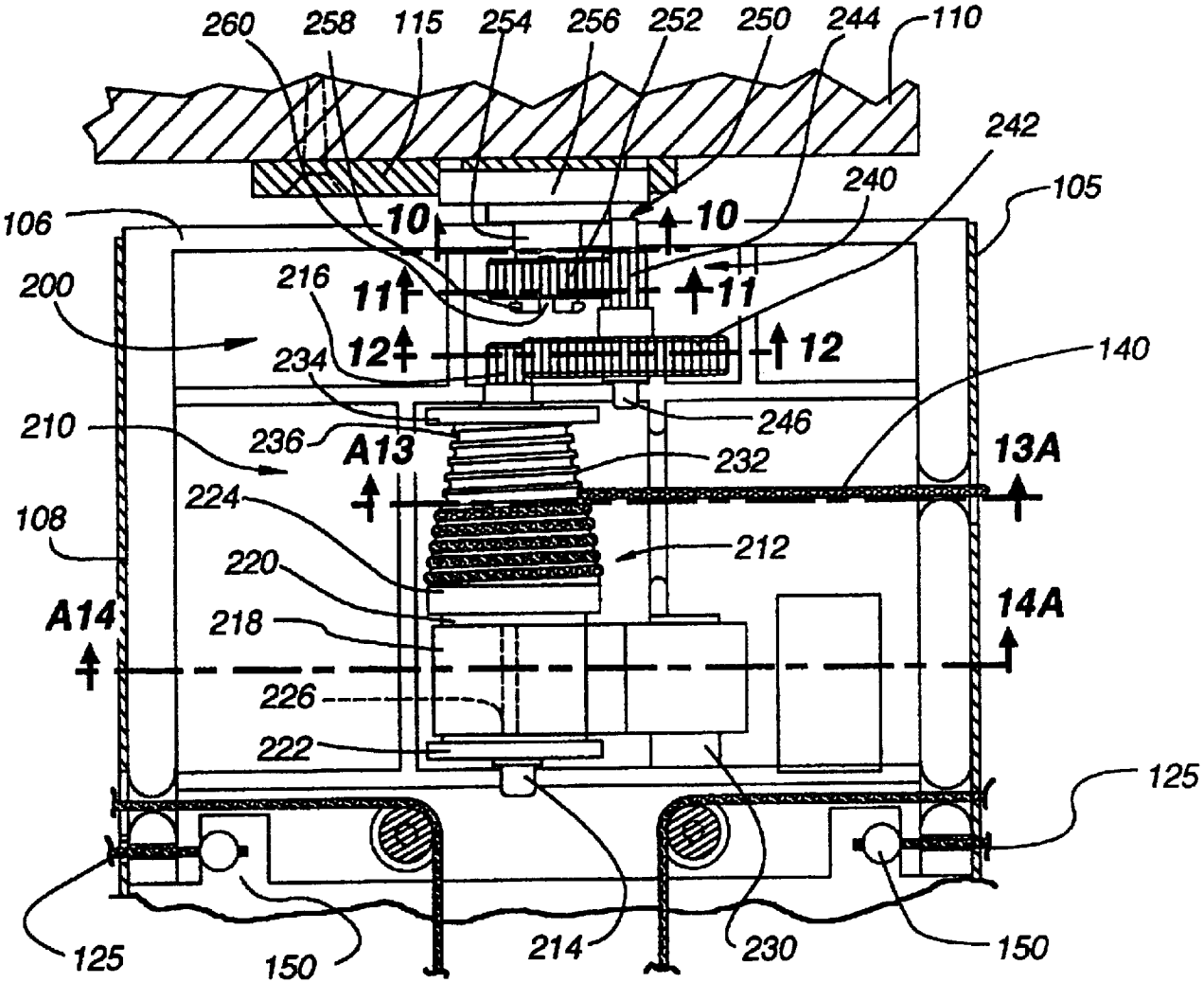
FIG. 7 is a top view of the balanced tilt mechanism taken along line 7—7 of FIG. 2 illustrating the positioning of the tilt actuating cord on the tapered bobbin when the vanes are in the fully open tilt position as illustrated in FIG. 3.
Figure 14C:
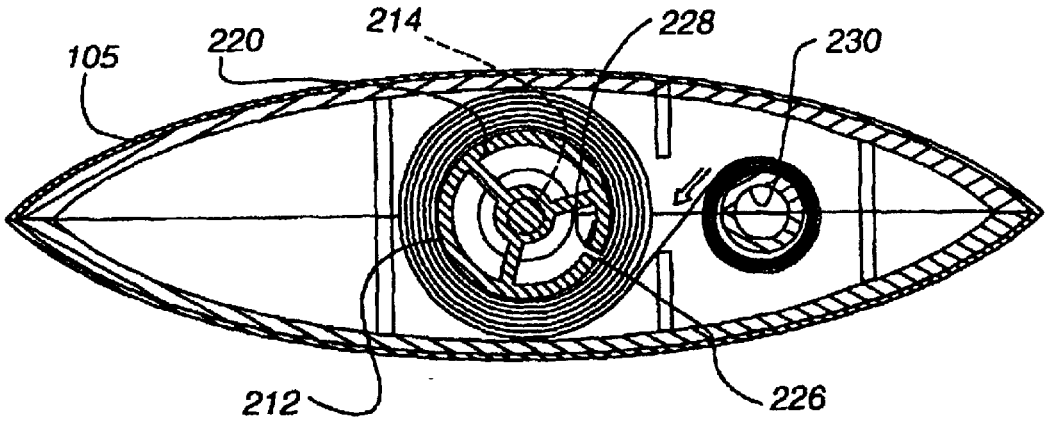
FIGS. 14A–14C are partial cross sectional views of the balanced tilt mechanism taken along line 14A—14A of FIG. 7 illustrating the positioning of the constant tension-type spring when the slats are in three different tilt positions: the fully open position; the second closed position; and the first closed position respectively.
Figure 14A:
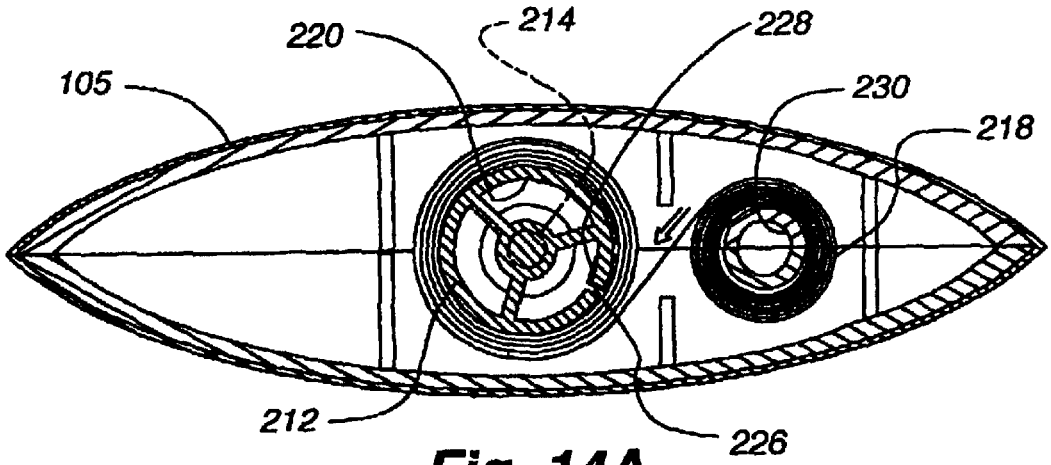
Figure 14B:
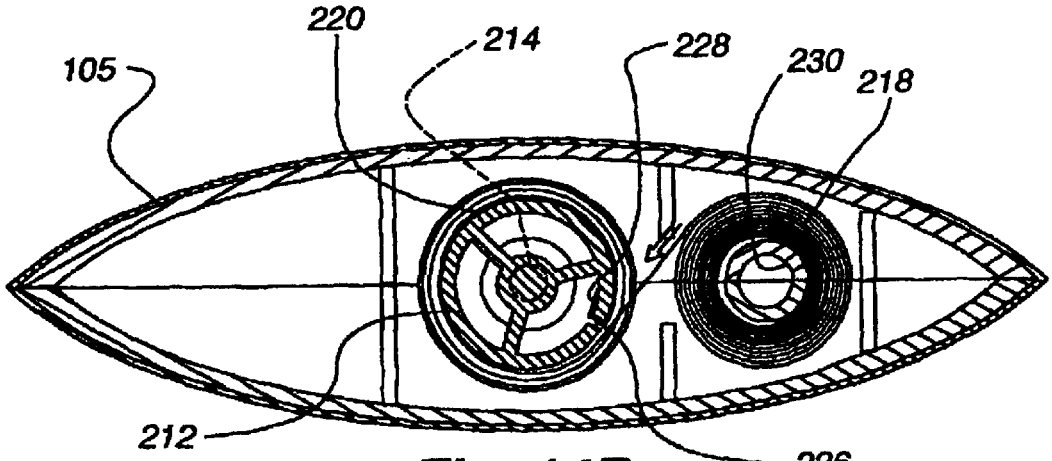
Figure 15:
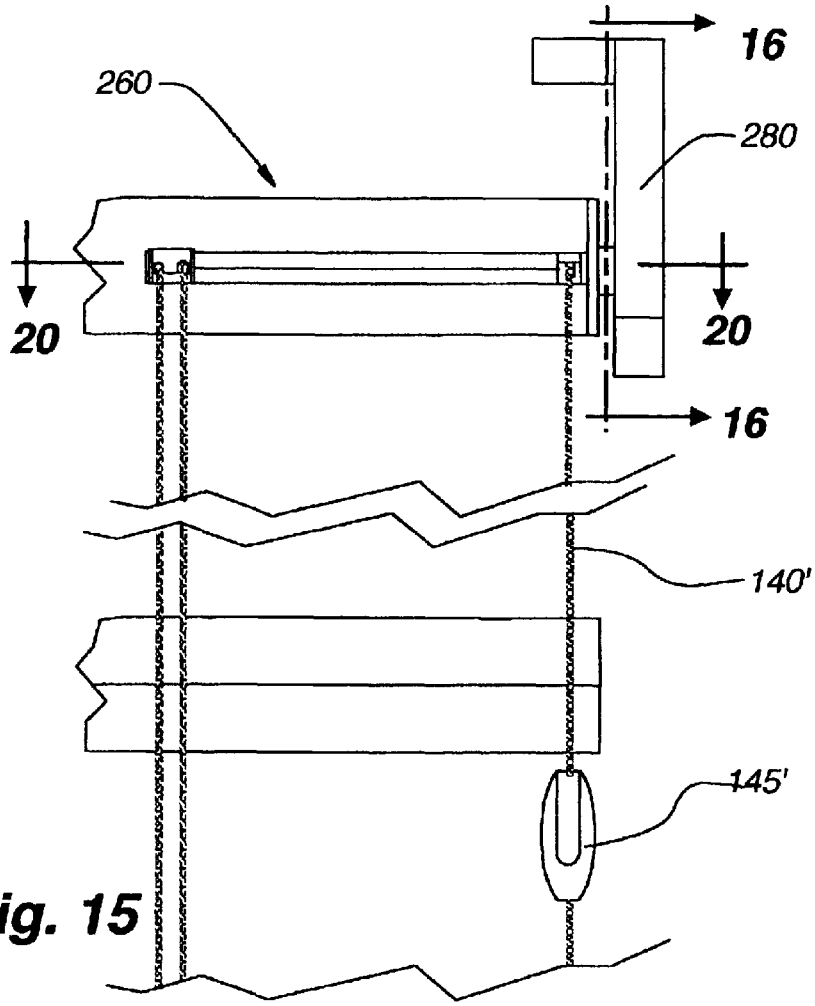
FIG. 15 is a fragmentary diagrammatic elevation of a second embodiment of the balanced tilt mechanism.

As illustrated by the arrows in FIGS. 4–6, by pulling the tassel 145 and/or associated tilt actuator cord 140 upwardly or downwardly, the head rail pivots about the mounting brackets 115 causing the associated slats 130 to pivot as well. By pulling downwardly with a small force on the tassel 145 as shown in FIG. 4, the effective downwardly acting force is increased to an amount greater than an upwardly acting force applied by the contravening spring 218 (as best shown in FIGS. 14A–C described in detail below). Accordingly, the head rail and the slats pivot in a clockwise direction until reaching a first closed position. The first closed position is illustrated in FIG. 5. Conversely, by gently pulling or pushing upwardly on the tassel 145 or the lift actuator cord 140, the effective downwardly acting force as applied by the tassel weight is decreased to an amount below the upwardly acting force applied by the contravening spring. Accordingly, the head rail and the slats pivot in a counterclockwise direction until reaching a second closed position as illustrated in FIG. 6.

It is to be appreciated the amount of force that must be applied by the user is very small comprising only the amount of force necessary to overcome any rotational friction inherent in the tilt mechanism. The amount of friction is largely dependant on the design of the mechanism, but a small amount of friction is desirable and necessary to prevent the slats from tilting to and fro when encountering even the smallest external forces, such as might be the result of breezes passing through an open window for example. It is contemplated that in alternative embodiments, a mechanism may be provided, such as a clamp arrangement around one or more of the pivoting shafts of either the tilt mechanism or the head rail to allow adjustment of the level of friction in the system.

The Balanced Tilt Mechanism

Referring to FIGS. 7–14C, the tilt mechanism 200 is illustrated. In general, the balanced tilt mechanism comprises: (i) the tilt actuator cord 140; (ii) the weighted tassel 145; (iii) a bobbin/spring assembly 210 including a tapered bobbin 212 rotatably mounted within the head rail by a bobbin shaft 214, a bobbin spur gear 216, and a constant tension-type spring 218; (iv) a spur gear assembly 240 including a large spur gear 242 and a small spur gear 244 attached by a rotating shaft 246; and (v) a mounting bracket attachment assembly 250 including a rotationally fixed spur gear 252, and a head rail shaft 254 about which the head rail pivots.

Figure 8:
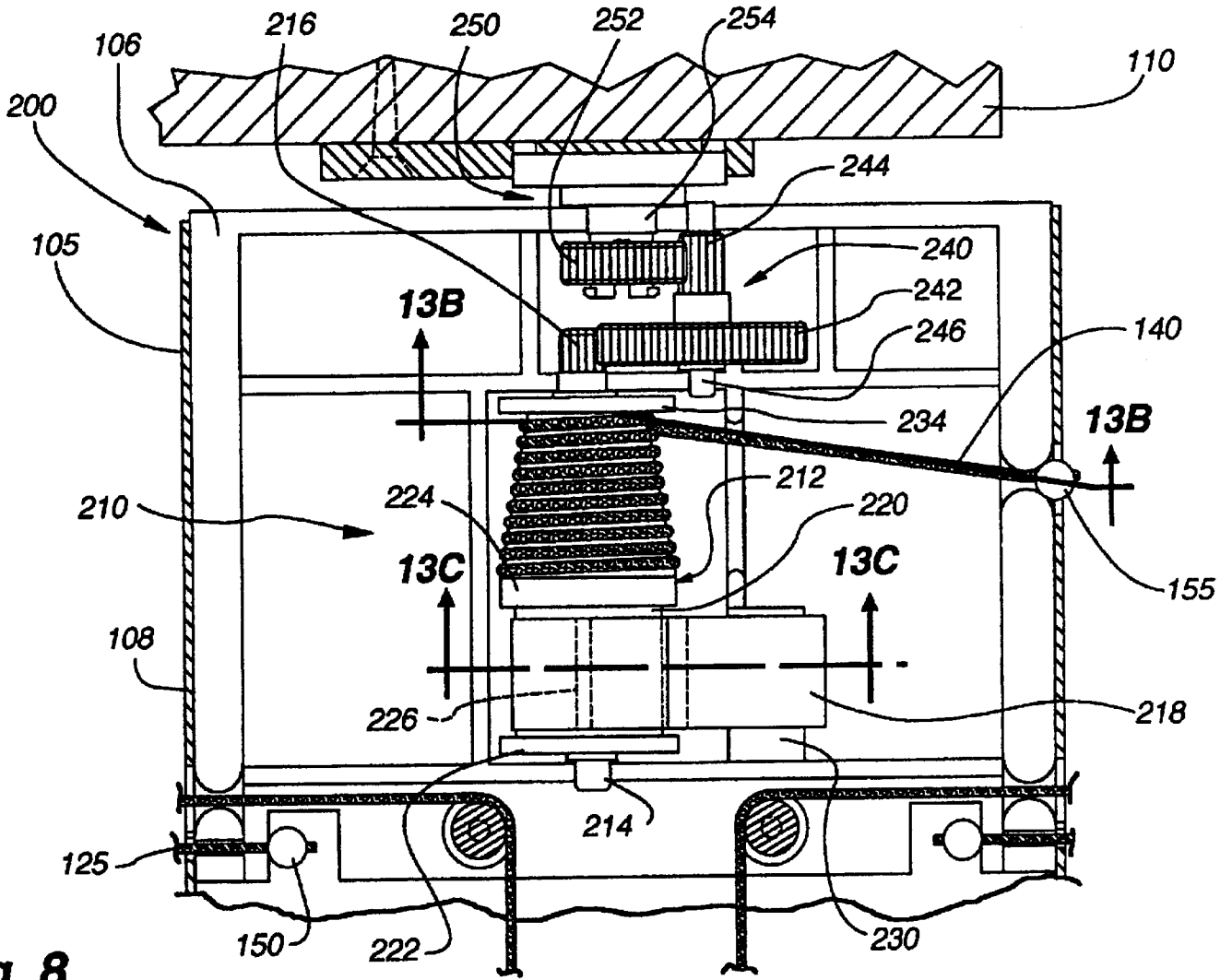
FIG. 8 is a top view of the balanced tilt mechanism taken along line 7—7 of FIG. 2 illustrating the positioning of the tilt actuating cord on the tapered bobbin when the vanes are in a second closed tilt position as illustrated in FIG. 6.
Figure 9:
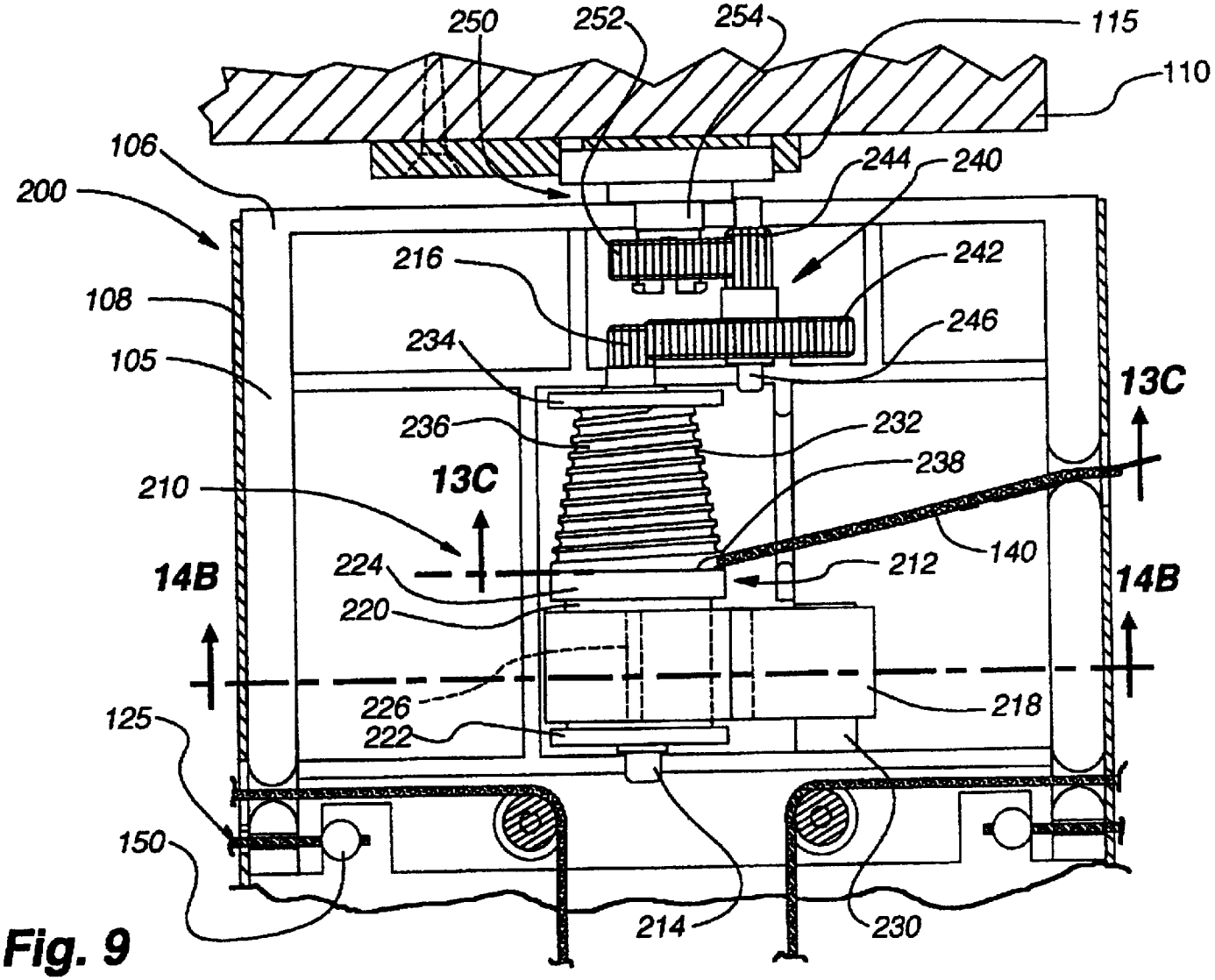
FIG. 9 is a top view of the balanced tilt mechanism taken along line 7—7 of FIG. 2 illustrating the positioning of the tilt actuating cord on the tapered bobbin when the vanes are in a first closed tilt position as illustrated in FIG. 5.

The bobbin/spring assembly 210 is best illustrated in FIGS. 7–9 with transverse cross sections of the tapered bobbin 212 provided in FIGS. 13A–C and 14A–C. The primary component of the bobbin/spring assembly is the tapered bobbin 212. The tapered bobbin acts to transfer the spring force from the spring 218 to the tilt actuator cord 140 and to secure the tilt actuator cord to the tilt mechanism. The tapered bobbin 212 is generally cylindrical with a tapered conical section and is adapted for rotation about a bobbin shaft 214 that extends through the tapered bobbin's longitudinal axis. The tapered bobbin can be fabricated from any number of suitable materials including metals, plastics and composites, but in the preferred embodiment, the tapered bobbin is fabricated from an injection molded plastic. The bobbin shaft 214 that is typically fabricated from a metallic material is press fit onto the bobbin along the bobbin's longitudinal axis. Alternatively, the shaft may be keyed to the shaft or adhesively bonded to the shaft for unitary rotation therewith. In an alternative embodiment, the bobbin shaft can be integrally molded with the bobbin. The bobbin shaft is rotatably received at either end of the bobbin into slots or openings formed in the head rail 105. It is appreciated that as illustrated in FIGS. 7–9 that the tilt mechanism is supported in an end cap section 106 of the head rail that is received in a longitudinally-extending typically extruded section 108 of the head rail 105.

The tapered bobbin/bobbin shaft combination comprises several sections along its longitudinal length including a spring section 220 at one end of the tapered bobbin 212. The spring wrap section 220 is essentially cylindrical and is bounded on both ends by first and second radial flanges 222 and 224. A longitudinally-extending slot 226 (best illustrated in FIG. 14A) is provided through the wall of the cylindrical spring section for securing a hooked end 228 of the spring 218. As the slats are tilted in either direction during the operation of the tilt mechanism 200, the constant tension-type spring 218 either wraps around the spring section 220 or unwinds from the spring section 220 and wraps around a post 230 provided in the head rail 105.

Figure 13B:
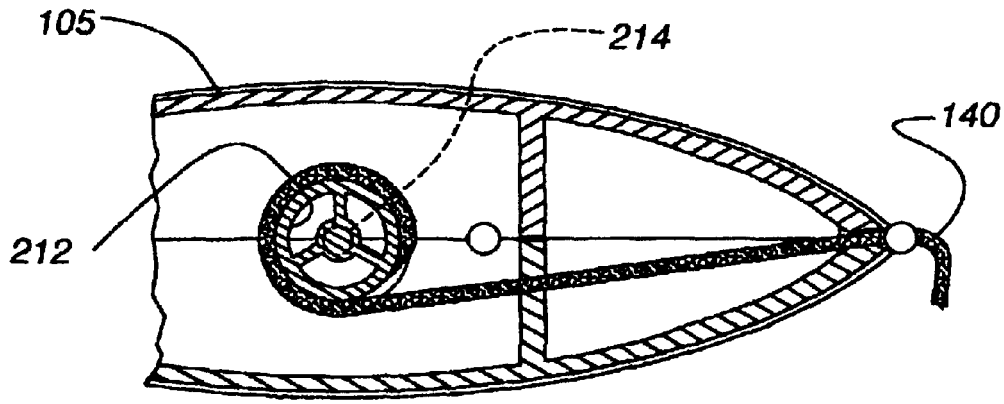
FIGS. 13A–13C are partial cross sectional views of the balanced tilt mechanism taken along line 13A—13A of FIG. 7 illustrating the positioning of the tilt actuating cord relative to the bobbin when the slats are in three different tilt positions: the fully open position; the second closed position; and the first closed position respectively.
Figure 13A:
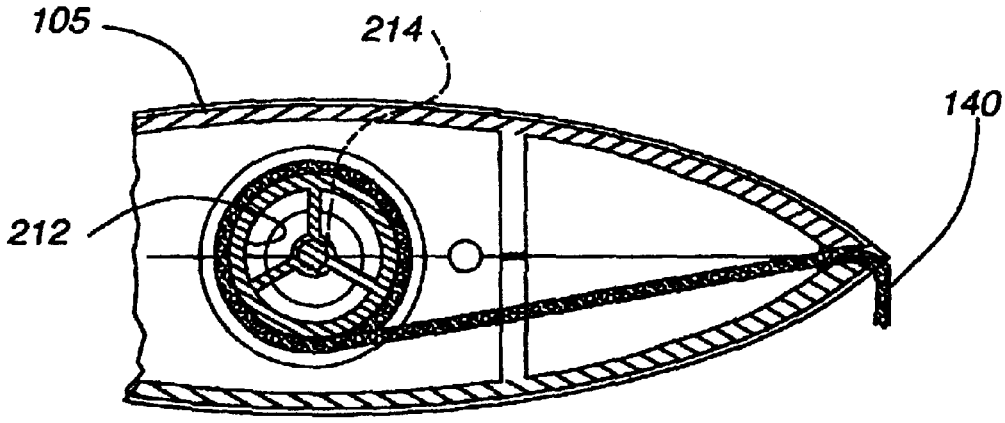
Figure 13C:
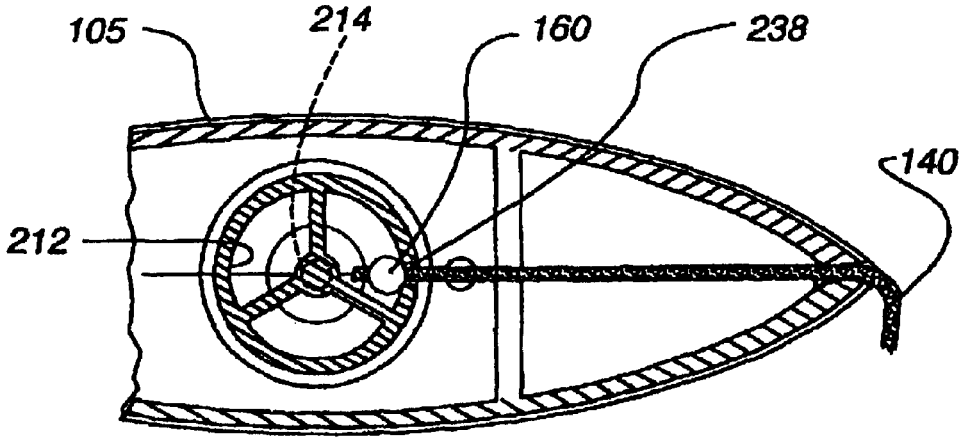

The tapered bobbin 212 also includes a tapered section 232 between the second radial flange 224 and a third radial flange 234 wherein the wall of the bobbin is tapered from a first diameter proximate the second radial flange to a second smaller diameter proximate the third radial flange. The change in the diameter around which the cord is wrapped changes the bias on the bobbin caused by the tassel and thereby compensates for changes in the biasing force provided by the spring 218 depending on the amount of the spring that is wrapped around the spring section 220. The surface of the tapered section also includes a continuous groove 236 which extends from one end of the section 232 to the other wrapping about the surface of the tapered section multiple times. The groove is sized to receive the tilt actuator cord 140 therein to guide the cord as it is wound and unwound from the bobbin 212 during tilting operations. Proximate the second flange 222, a hole 238 of sufficient diameter to receive the top end of the tilt actuator cord passes through the wall of the tapered section 232 at one end of the continuous groove 236 (as best shown in FIG. 13C). This hole is used to secure the tilt actuator cord to the bobbin by passing the cord through the hole and either knotting the end or affixing an adhesive bead 160 to the end of the cord that cannot fit back through the hole.

Finally, the bobbin shaft 214 that passes through and is fixedly secured to the tapered bobbin 214 has a bobbin spur gear 216 located above the tapered section 232 on the other side of the third flange 234. The bobbin spur gear 216 is fixedly received onto the bobbin shaft for unitary rotation therewith. The bobbin spur gear can be keyed to the bobbin shaft, press fit onto the bobbin shaft, adhesively bonded to the shaft or affixed to the shaft by any suitable means. In an alternative embodiment, where the bobbin shaft is integrally fabricated with the tapered bobbin, the bobbin spur gear can also be integrally molded with the tapered bobbin.

Referring to FIG. 7 and FIGS. 14A–C, as mentioned above, one end of the constant tension-type spring 218 is hooked within a slot 226 in the spring section 220 of the bobbin 212. The other end of the spring is wrapped around the spring post 230 provided in the head rail 105 to receive the spring. The spring is typically fabricated from spring steel and provides a generally continuous tension across the span of the spring between the portion of the spring wrapped around the spring section 220 and the portion of the spring wrapped around the spring post 230 in the direction of the spring section as indicated by the arrows in FIGS. 14A–C. Accordingly, the spring applies a clockwise bias to the tapered bobbin 212.

As successive layers of spring 218 are wrapped around the spring section 220, the effective counterclockwise rotational moment applied to the tapered bobbin 212 from the spring increases since the distance from the longitudinal axis to the biasing portion of the spring increases and the force applied by the spring remains constant (the rotational moment is equal to the distance from the longitudinal axis to the location where the load is being applied times the force being applied). It is to be appreciated that in order for the bobbin to remain stationary when the tilt mechanism is not being operated the counterclockwise rotational moment applied by the weighted tassel 145 acting through the tilt actuator cord 140 must be the same as the contravening rotational moment applied by the spring. As the clockwise rotational moment increases, the counterclockwise rotational moment must also increase. The tapered section 232 of the tapered bobbin causes the counterclockwise rotational moment to change in concert with the counterclockwise rotational moment.

For instance when the spring is wound its maximum amount around the spring section 220 of the bobbin 212 as shown in FIG. 14C, the tilt actuator cord will be completely unwound from the tapered section and be located at the largest diameter portion of the tapered section as shown in FIG. 9. When the spring and the tilt actuator cord are in these positions on the tapered bobbin, the vanes will be in their first closed position as shown in FIG. 5.

Conversely, when the spring is wound its minimum amount around the spring section 220 of the bobbin 212 as shown in FIG. 14B, the tilt actuator cord 140 will be wound around the tapered section 232 its maximum amount and the portion of the cord coming off of the tapered section will be located at the smallest diameter portion of the tapered section as shown in FIG. 8. When the spring and the tilt actuator cord are in these positions on the tapered bobbin, the vanes will be in their second closed position as shown in FIG. 6.

The spur gear assembly 240 and the mounting bracket assembly 250 are provided to transfer the rotational movement of the tapered bobbin 212 during a tilting operation to pivotal movement of the head rail 105 and the associated slats 130. The spur gear assembly 240 and the mounting bracket assembly 250 are best illustrated in FIG. 7–12. The spur gear assembly includes the spur gear shaft 246 that is rotationally mounted to the head rail and has the large spur gear 242 affixed to it at one end and the small spur gear 244 affixed to it at the other end. The large spur gear is meshed with the bobbin spur gear 216 (as best shown in FIG. 12) such that clockwise rotation of the bobbin spur gear causes the large spur gear and the entire spur gear assembly to rotate counterclockwise. The various components of the spur gear assembly can be made out of a variety of suitable materials including plastic, metals and composites. Further, the spur gears can be joined to the spur gear shaft in any suitable manner including but not limited to press fitting, adhesive bonding, welding, brazing and keyed fitment. Additionally, in an alternative embodiment, the entire spur gear assembly can be injection molded as a single piece using a suitable reinforced or unreinforced plastic.

Figure 11:
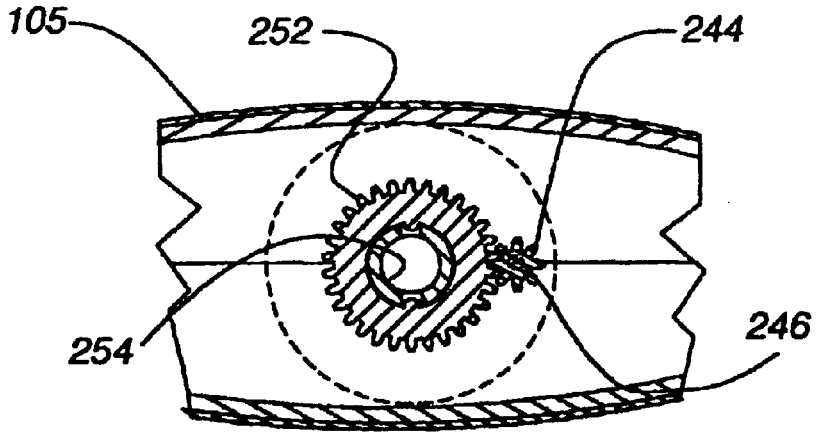
FIG. 11 is a cross sectional view of the balanced tilt mechanism taken along line 11—11 of FIG. 7.
Figure 12:
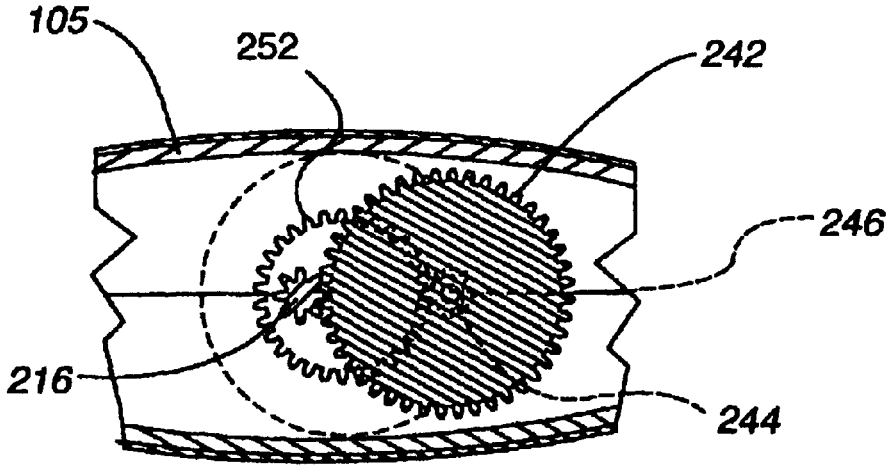
FIG. 12 is a cross sectional view of the balanced tilt mechanism taken along line 12—12 of FIG. 7.

As best shown in FIGS. 7 and 11 the small spur gear 244 is meshed with the fixed spur gear 252 of the mounting bracket assembly. The fixed spur gear is secured to the end of the head rail shaft 254 of the mounting bracket pad 256 that is fixedly secured to the mounting bracket 115. Accordingly, the fixed spur gear does not rotate. Rather the small spur gear 244 moves around the surface of the fixed spur gear and since the small spur gear, the spur gear assembly and the tapered bobbin assembly are all contained within and attached to the head rail, the head rail also pivots relative to the fixed spur gear.

In the afore-described embodiment, the fixed spur gear 252 has an axial opening that is keyed to a corresponding portion of the head rail shaft 254 as is best illustrated in FIG. 11. The head rail shaft further includes a radial flange 258 at its end to hold the fixed spur gear in place and prevent it from sliding off the end of the head rail shaft. In this portion of the head rail shaft there are two opposing slots 260 in the walls of the shaft 254 allowing the remaining walls to resiliently flex inwardly as the fixed spur gear 252 is snapped into place. In alternative embodiments, the gear 252 may be fixed to the head rail shaft in any suitable manner including welding and bonding.

Figure 10:
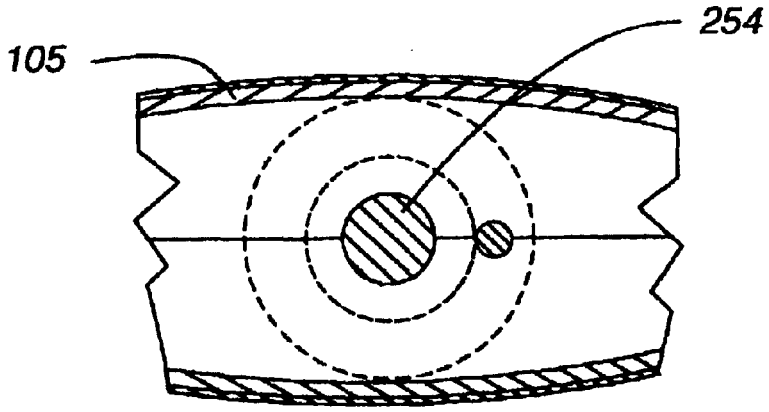
FIG. 10 is a cross sectional view of the balanced tilt mechanism taken along line 10—10 of FIG. 7.

As best shown in FIGS. 7 and 10, the end of the head rail 105 is pivotally mounted to the mounting bracket assembly 250 at another portion of the head rail shaft 254. The head rail is free to pivot about the shaft but cannot slide longitudinally off the shaft as prevented by the mounting bracket pad 256, which is typically integral with the shaft 254, on one side and the fixed spur gear 252 on the other side. It is to be appreciated that the head rail 105 is longitudinally secured to a modified mounting bracket assembly for pivotal movement on the other end of the head rail although no fixed spur gear is required.

In the this embodiment of the invention, the mounting bracket pad 256 includes a spring catch (not shown) molded therein or otherwise attached to the pad. The spring catch is designed to be received in a plurality of mounting holes (not shown) disposed in the mounting bracket 215 at spaced circular locations about a center point coincident with the longitudinal axis of the head rail shaft 254. Accordingly when mounting the blinds to an opening, the mounting brackets 215 are first positioned and secured to the frame 110 of the opening. Next, the tilt mechanism 200 is activated to move the blinds into one of the closed positions before attaching the mounting bracket pads 256 to the mounting bracket. Finally, the pads 256 are aligned to the bracket with the head rail and slats substantially vertically disposed in their lateral direction and the pads are snapped into place.

It is to be appreciated that depending on the various sizes of the spur gears 216, 242, 244, and 252 utilized throughout the tilt mechanism 200, the amount of weighted tassel movement necessary to move the slats 130 from one closed position to another can be varied as would be obvious to one of ordinary skill in the art. In the preferred embodiment, the total travel of the tilt actuator cord 140 and the associated weighted tassel 145 is about 22 inches, although the gearing could be changed to reduce that travel especially when used with small shades that are not very tall. To prevent the tilt actuator cord from over winding onto the tapered bobbin 212 when pivoting the slats into the second closed position, the tilt actuator cord has a adhesive bead 155 attached to it that braces against the cord opening in the head rail when the cord slats are fully tilted and the cord is fully wound about the tapered bobbin as shown in FIG. 8.

Operation of the Blind Assembly and the Balanced Tilt Mechanism

As described above and illustrated in FIGS. 4–5, to pivot the shades from the fully open position to the first closed position, a user gently pulls on the weighted tassel 145 or the tilt actuator cord 140. The force only need be enough to overcome any friction built into the tilt mechanism. As illustrated in FIG. 13A, when the tapered bobbin is rotated in a counterclockwise direction, causing additional spring to be unwound from the spring section 220 of the bobbin as illustrated in FIG. 14C, it increases the clockwise acting rotational moment applied to the bobbin by the spring. To maintain the balance of forces, the tilt actuator cord moves along the groove 236 to a portion of the tapered section 232 having a greater diameter as shown in FIG. 9 thus increasing the counterclockwise bias on the bobbin which is applied by the tassel. The counterclockwise rotation of the tapered bobbin 212 and the fixedly attached bobbin spur gear causes the spur gear assembly, which is meshed to the bobbin spur gear through the large spur gear 242, to rotate clockwise. The small spur gear 244, which is meshed against the fixed spur gear 252, moves clockwise around the fixed spur gear. Since the spur gear assembly is attached to the head rail 105, the head rail pivots clockwise about the mounting bracket assembly 250 as the small spur gear moves around the fixed spur gear. The counterclockwise pivotal movement of the head rail causes the front vertical cord of the ladder tape 125 to rise, the rear vertical cord to be lowered, and the slats to be tilted into the second closed position as shown in FIG. 5.

The foregoing balanced tilt mechanism has been described in terms of use with a blind assembly incorporating a tilting head rail. It is to be appreciated that elements of the balanced tilt mechanism can also be utilized in a more conventional Venetian blind assembly with a fixed head rail. In such an application the tapered bobbin/spring assembly would be interfaced either directly or through one or more gears with a tilt rod that extends within the head rail. By either lifting or pulling on the weighted tassel the balance of forces would be upset and the tapered bobbin and the tilt rod would rotate to effect the tilting of the blind assembly's slats. The balanced tilt mechanism could also be incorporated into other types of window coverings that tilt or pivot slats.

Additionally, many variations of the various components of the tilt mechanism are contemplated. For instance, the type of spring utilized could be varied or in another embodiment the spring could be replaced with a second weight that hangs down the back side of the blind to counteract the weighted tassel. In other embodiments, the various gears could be replaced as applicable by pulleys and drive belts. In other variations, the bobbin may not be tapered. The scope of the invention is not intended to be limited to the specific embodiment described herein, rather, the described embodiments are provided by way of example.

An alternative embodiment 260 to that described previously is illustrated in FIGS. 15–28. This alternative embodiment is quite similar to the previously described embodiment so that like parts have been given like reference numerals with a prime suffix.

The embodiment 260 of FIGS. 15–28 includes a tilt mechanism 262 that comprises (i) a tilt actuator cord 140'; (ii) a weighted tassel 145'; (iii) a bobbin/spring assembly 264 including a tapered bobbin 266 rotatably mounted within the headrail 105' by a bobbin shaft 214', a bobbin spur gear 216', a constant tension-type spring 269; (iv) a spur gear assembly 240' including a large spur gear 242' and a small spur gear 244' attached by a rotating shaft 246'; and (v) a mounting bracket attachment assembly 270 including a rotationally fixed spur gear 272, a mounting disc 274, and a headrail shaft 276 about which the headrail pivots. The aforenoted tilt mechanism 262 is mounted in a housing 278 having upper **278*u* and lower 2781** components, which are releasably connected together to confine the working components in predetermined positions for reliable operation of the tilt mechanism.

The housing 278 with the tilt mechanism components therein is adapted to be inserted into the open end of the hollow tubular headrail 105' of the type previously described and positively positioned contiguous with the end of the headrail in any suitable manner such as by friction, adhesive or the like. Further, the housing and tilt mechanism are operably and releasably mounted on a bracket 280 that is fixed to the framework (not shown) of an architectural opening so that the housing, tilt mechanism, and associated headrail can be tilted relative to the bracket upon operation of the tilt mechanism.

Figure 18:
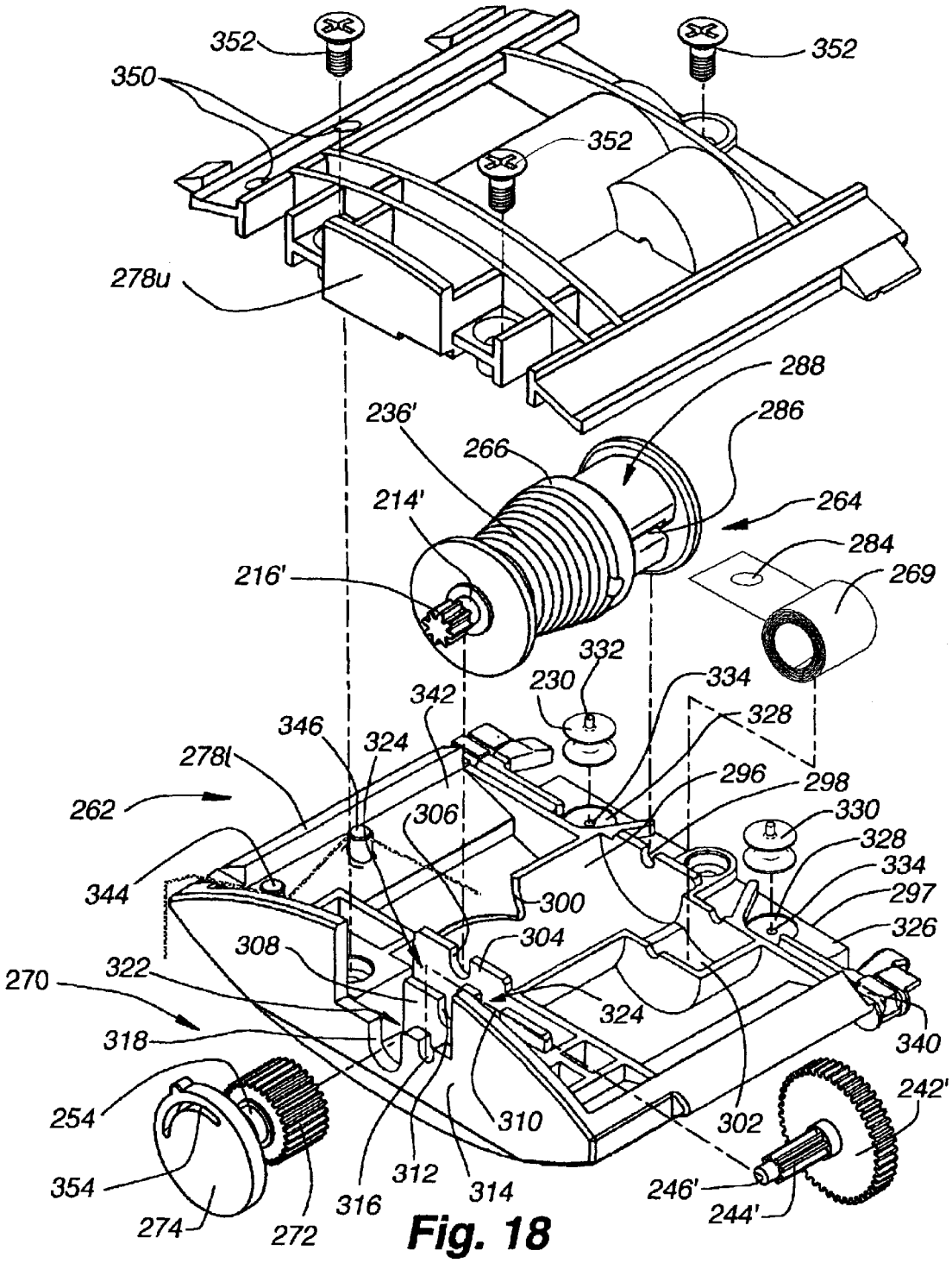
FIG. 18 is an exploded isometric showing the component parts of the embodiment of the invention shown in FIG. 15.
Figure 19:
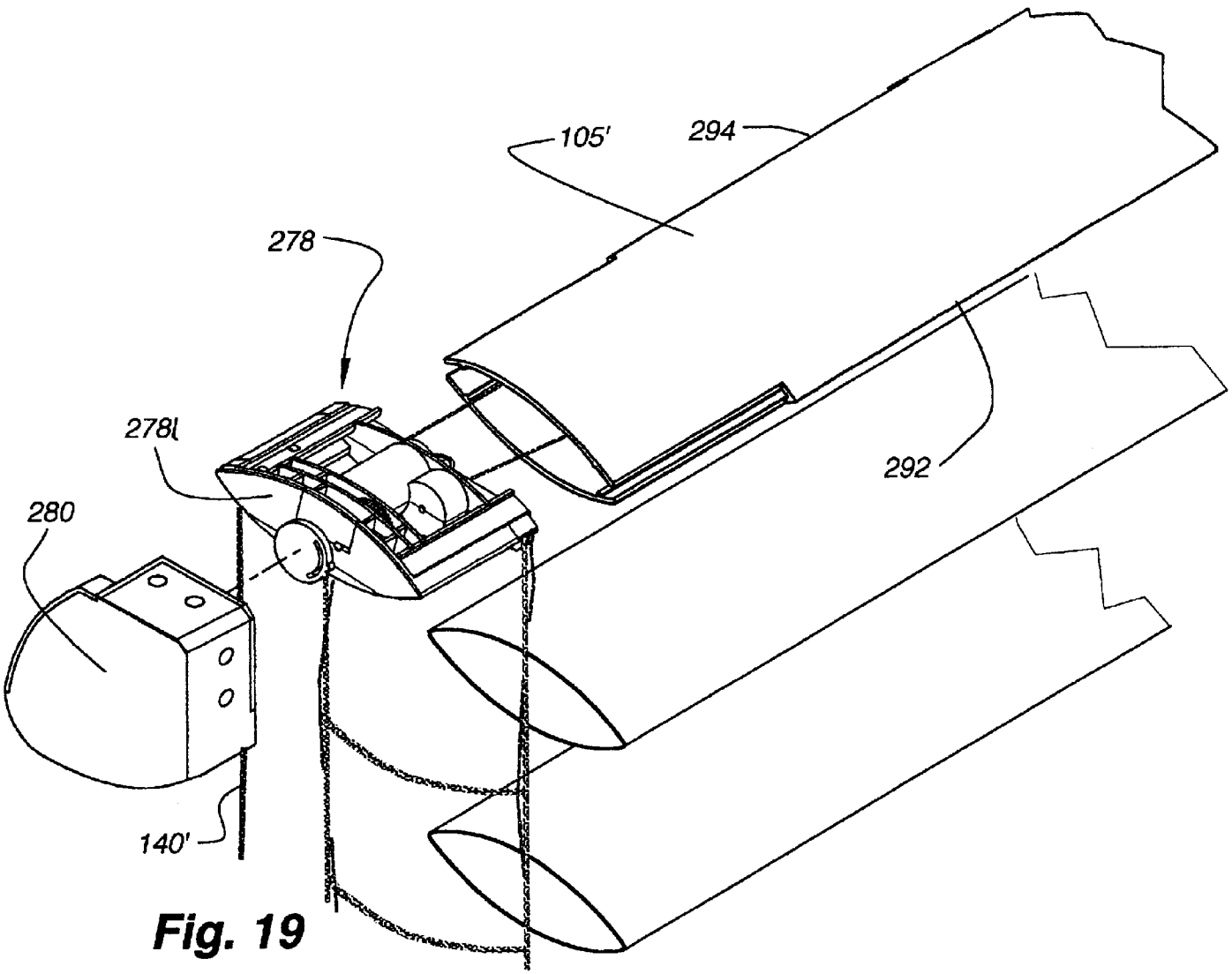
FIG. 19 is a fragmentary exploded isometric showing the balanced tilt mechanism of the embodiment of FIG. 18 removed from the end of the headrail and with a cord ladder and suspended slats shown with the balanced tilt mechanism.
Figure 28:
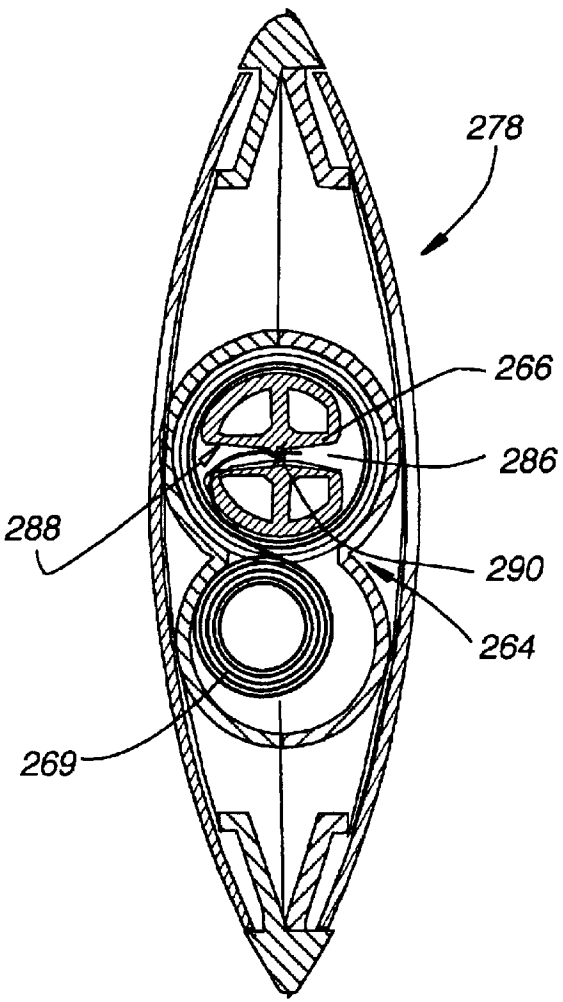
FIG. 28 is a section taken along line 28—28 of FIG. 20.
Figure 27:
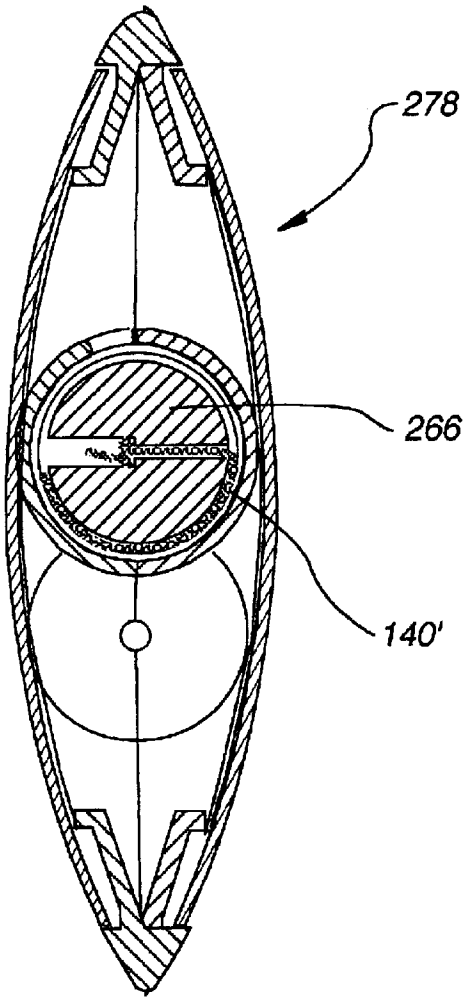
FIG. 27 is a section taken along line 27—27 of FIG. 20.

The bobbin/spring assembly 264 is best illustrated in FIGS. 18 and 20–28. The primary component of the bobbin/spring assembly is the bobbin 266 which is identical to the bobbin described in the previous embodiment except for the manner in which the constant tension spring 269 is secured to the bobbin. In this embodiment of the invention, the end of the constant tension spring has an aperture 284 punched therethrough and as is best seen in FIGS. 18 and 28, the end of the spring is adapted to be inserted into a slot 286 provided in the cylindrical spring wrap section 288 of the bobbin 266 where the aperture is disposed around a transverse pin 290 formed in the interior of the spring wrap section of the bobbin. It will therefore be appreciated by reference to FIG. 28 that rotation of the bobbin causes the constant tension spring to be wrapped around or unwrapped from the spring wrap section depending upon the direction of rotation of the bobbin and its relative relationship to the constant tension spring.

The upper and lower housing components **278*u* and 2781 are complementary but not identical. As probably best seen in FIGS. 18 and 20, the lower section has a number of dividers, bearing seats, and cradles for receiving various component parts of the tilt mechanism as will be described hereafter. Along an axis of the housing 278 and transversely centered between opposite edges of the housing that correspond with opposite inner and outer edges 292 and 294 respectively of the headrail 105', an elongated generally semi-cylindrically shaped, relatively large cradle 296 is provided to rotatably receive the bobbin 266. Axially aligned with the cradle 296 along an inner end 297 of the housing is a first bearing seat 298 adapted to rotatably support the shaft 214' of the bobbin. Adjacent to the outer end of the cradle, so as to be in adjacent side-by-side relationship with the tapered conical body of the bobbin when the bobbin is seated in the cradle, an arcuate tapered notch 300 is formed to guide the actuator cord 140'** as it is fed to and off the bobbin as will be described in more detail later.

Adjacent to the inner end of the relatively large cradle 296, a second smaller cradle 302 is formed that communicates laterally with the relatively large cradle and is adapted to seat the constant tension spring 269 in its rolled form such that the end of the spring having the aperture 284 therethrough can extend into the larger cradle where it is releasably attached to the bobbin 266 as described previously.

At the outer end of the larger cradle 296, a first transverse divider wall 304 is formed having a second bearing seat 306 axially aligned with the bobbin 266 for rotatably supporting the shaft 214' on which the bobbin spur gear 216' is mounted. Accordingly, between the seats at the inner and outer end of the large cradle, the bobbin can be rotatably mounted for free rotation while being confined within the cradle.

Parallel to the first divider wall 304 but spaced outwardly therefrom is a second divider wall 308 having third 310 and fourth 312 bearing seats formed in its top edge with the third bearing seat 310 adapted to rotatably support an intermediate portion of the shaft 246' between the gear 242' and the gear 244'. The fourth bearing seat 312 is adapted to rotatably support the innermost end of the shaft for the spur gear 272. The outer wall 314 of the bottom housing component has fifth 316 and sixth 318 bearing seats with the fifth bearing seat supporting the outer end of the shaft 246' associated with the gears 242' and 244' while the sixth bearing seat supports an intermediate portion of a shaft 254 associated with the gear 272. The outer end of the shaft 272 has the mounting or support disc 274 secured thereon which will be described in more detail later for releasably connecting the tilt mechanism to the mounting bracket 280.

As will be appreciated, a pocket 324 is defined between the first 304 and second 308 transverse divider walls for confining the spur gears 216' and 242' while still another pocket 322 is defined between the second divider wall 308 and the outer end wall 314 of the lower housing component 2781 for confining the gears 244' and 272. There is just enough space between the divider walls and the end wall to allow the respective gears to rotate freely but to prevent them from tilting during operation of the tilt mechanism. Accordingly, the gears always remain in operative and meshed relationship as desired for dependable operation of the system.

Along the inner end wall 297 of the lower housing component 2781, a shelf 326 is provided with circular recesses 328 for rotatably receiving a pair of pulleys 330 having vertically extending axles 332 with one end of the axles being rotatably received in a centered aperture 334 within the circular recesses. As probably best appreciated by reference to FIG. 20, the pulleys 330 are provided to guide front and rear lift cords 135' which extend through transverse slots 340 along the lateral inner and outer edges of the lower housing component. The lift cords could be part of a system of the type described in the aforementioned PCT application No. PCT/US02/00225.

Along the outer lateral edge of the lower housing component 2781, a shelf 342 is provided having a pair of longitudinally spaced and slightly transversely offset upstanding pins 344 and 346 around which the actuator cord passes as shown in FIG. 18. It has been found that by passing the actuator cord around the pins, additional friction is established and improves the smoothness with which the tilting mechanism of the present invention operates. As will be appreciated, the rearmost pin 346 is transversely aligned with the arcuate notch 300 previously described in the large cradle 296 so that as the actuator cord 140' extends laterally from the upstanding rearmost pin 346 to the bobbin 266 within the cradle, it remains substantially perpendicular to the longitudinal axis of the bobbin whereby the actuator cord can be desirably fed onto the bobbin to dependably follow the helical groove 236' provided in the tapered surface of the bobbin.

As will be appreciated, when the actuator cord 140' is being wrapped around larger diameter portions of the bobbin, in order to feed the actuator cord substantially perpendicularly to the bobbin, it needs to be fed to the bobbin at a relatively low location but as the cord is fed to the bobbin towards the smaller diameter portions, in order to retain the perpendicular feeding, the cord must be fed at a higher location. The arcuate edge 348 of the notch 300 in the cradle, which becomes an arcuate slot 349 (FIG. 23) when the upper component of the housing 278 overlies the lower component, assures that the actuator cord is fed to the bobbin at a substantially perpendicular angle for most dependable operation of the tilt system.

The upper component 278*u* of the housing 278, while not being a precise mirror image to the lower component 2781, has cooperating dividers and cradles so as to confine the aforenoted operative components of the tilt system for dependable operation. Of course, divider walls in the upper component overlie the bearing seats in the lower component and further the upper component is provided with a pair of apertures 350 for receiving the upper end of the upstanding pins 344 and 346 so that the actuator cord 140' will retain its desired passage around the pins. While not being shown, complementary circular seats and holes are provided for receiving the upper ends of the pulleys 330 so they are confined between the upper and lower components of the housing and rotatably seated therein. Of course, screw-type fasteners 352 (FIG. 18) are provided for releasably securing the upper and lower components together once the operative components have been positioned therein.

Figure 16:
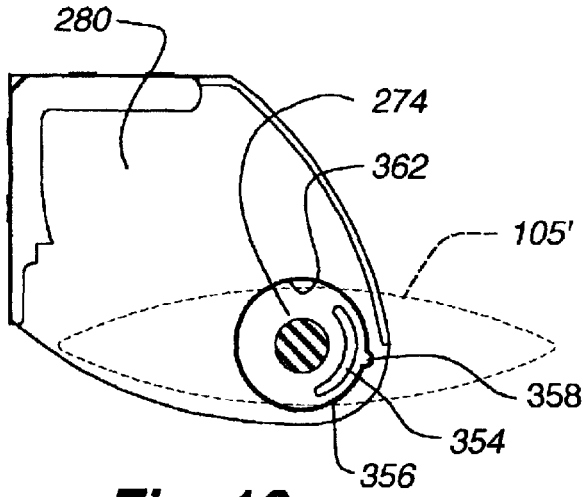
FIG. 16 is a section taken along line 16—16 of FIG. 15 wherein the headrail for the system is shown in dashed lines.
Figure 17:
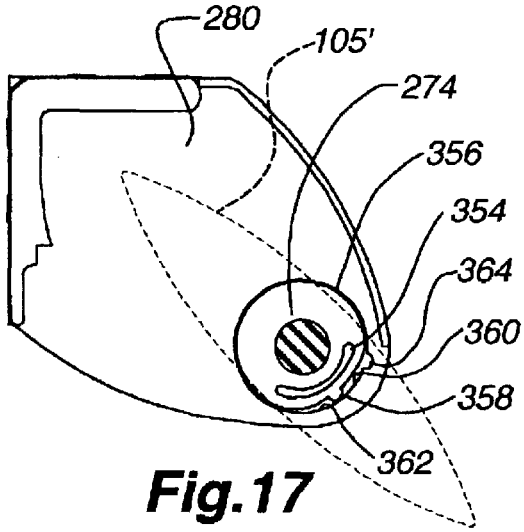
FIG. 17 is a section similar to FIG. 16 with the component parts in a different position.

As mentioned previously, the mounting or support disc 274 is provided beyond the outer end wall 314 of the lower housing compartment and rotates with the spur gear 272 to which it is operatively connected. As best seen in FIGS. 16–18, the mounting disc has an arcuate slot 354 formed therein adjacent to its periphery 356 and along the periphery of the disc, adjacent to the arcuate slot, a bead 358 projects radially outwardly.

Figure 20:
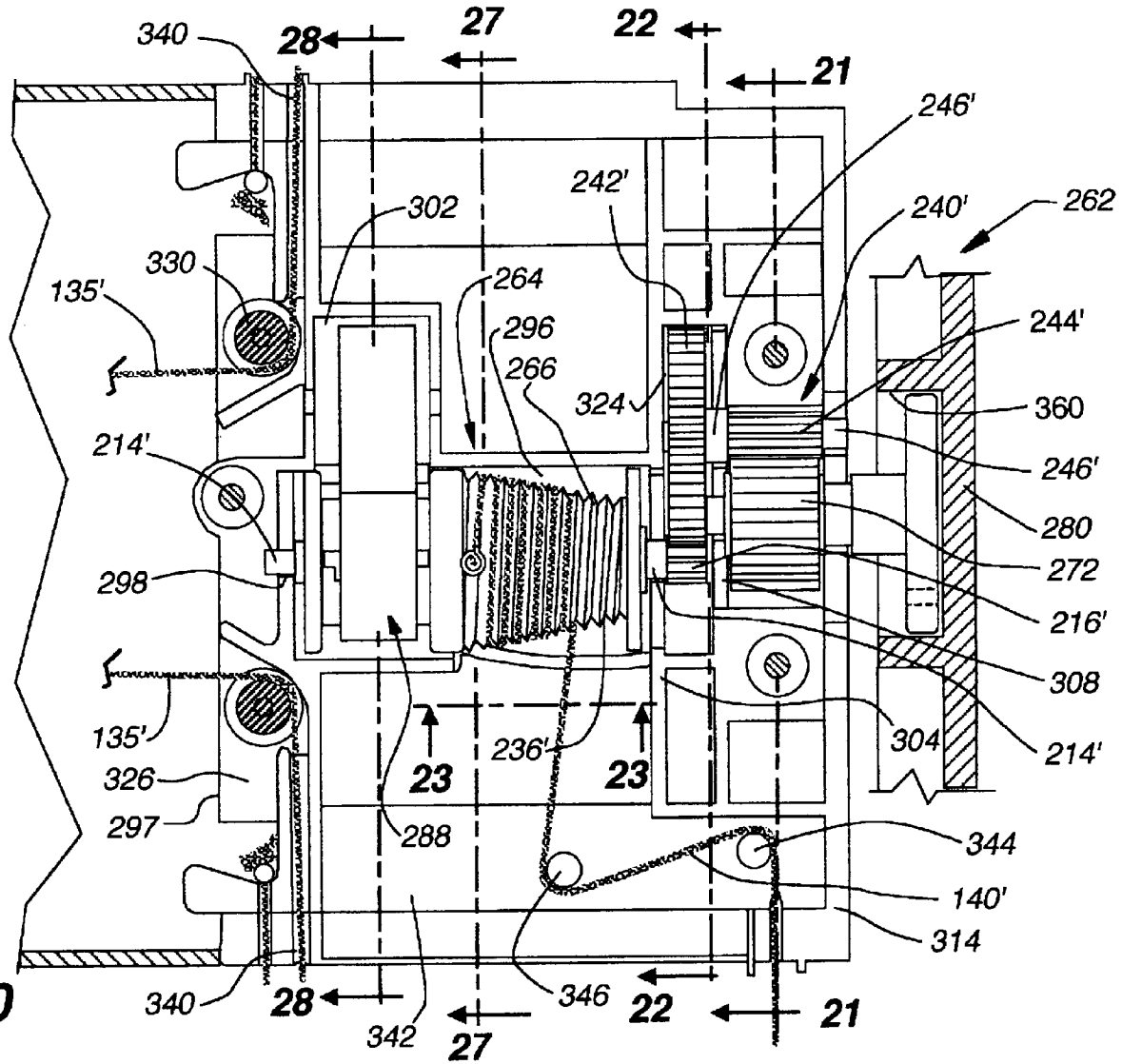
FIG. 20 is an enlarged fragmentary section taken along line 20—20 of FIG. 15.
Figure 22:
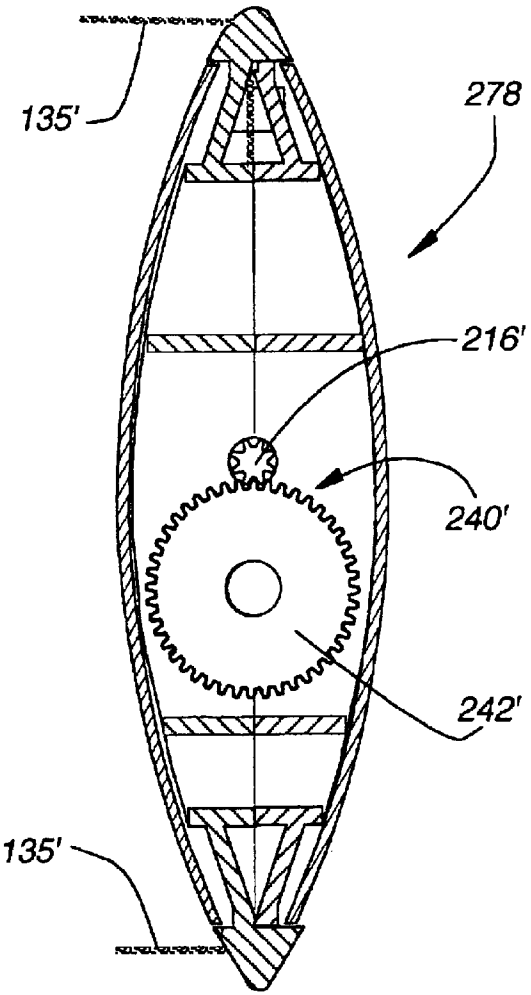
FIG. 22 is a section taken along line 22—22 of FIG. 20.
Figure 21:
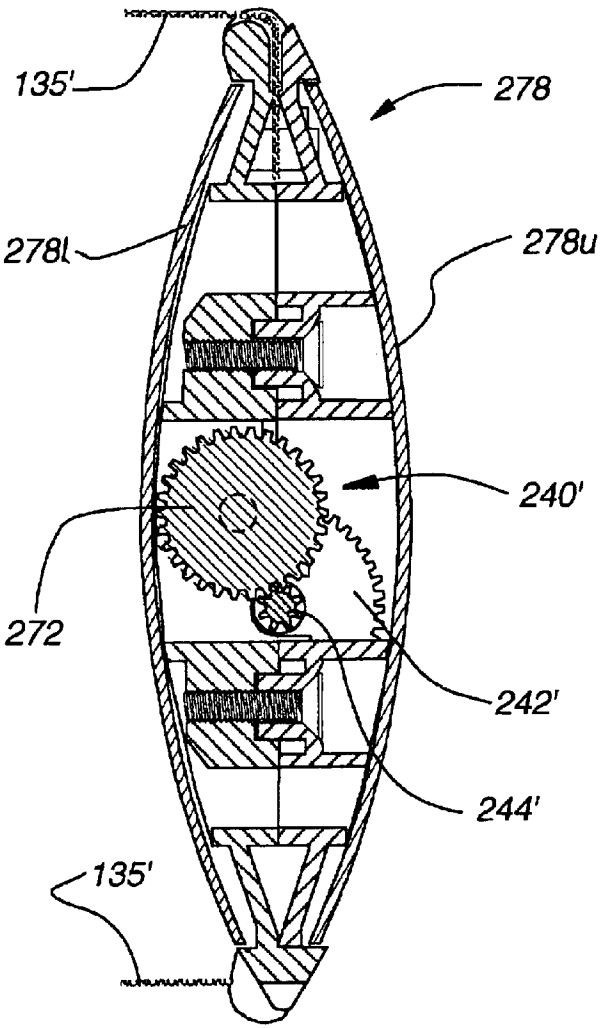
FIG. 21 is a section taken along line 21—21 of FIG. 20.
Figure 24:
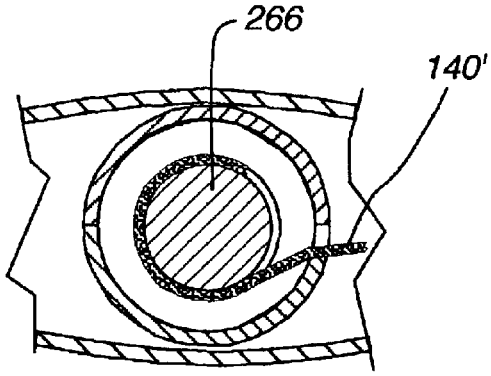
FIG. 24 is a fragmentary section taken along line 24—24 of FIG. 23.
Figure 23:
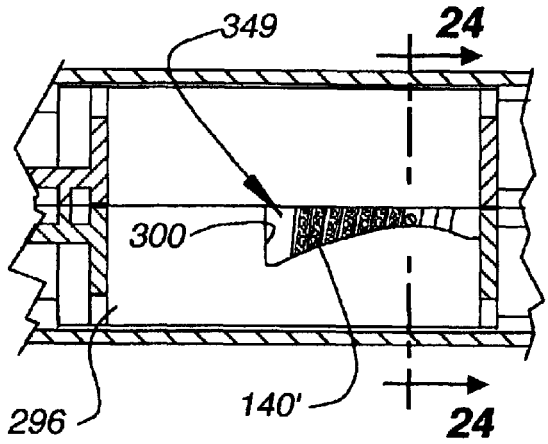
FIG. 23 is a fragmentary section taken along line 23—23 of FIG. 20.
Figure 26:
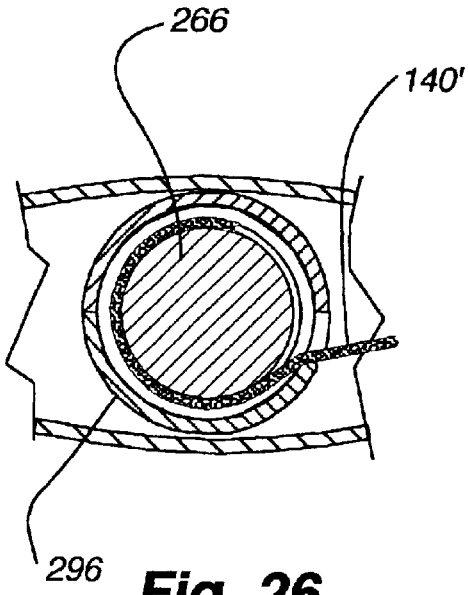
FIG. 26 is a section taken along line 26—26 of FIG. 25.
Figure 25:
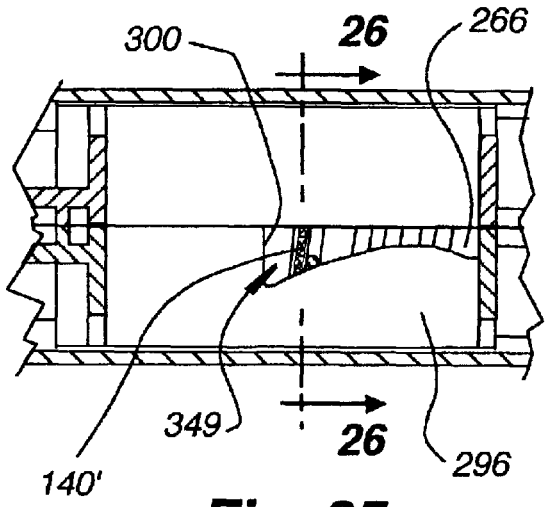
FIG. 25 is a section similar to FIG. 23 showing the actuator cord at a different location on the bobbin.

The bracket 280 on which the headrail 105' is mounted has a pocket or seat 360 as best seen in FIG. 20 which releasably retains the disc 274 and the pocket has an arcuate surface 362 as seen in FIGS. 16 and 17 having a detent 364 therein that matingly and releasably receives the bead 358. It is important to note that both the bead and the detent themselves have arcuate surfaces.

In accordance with the operation of the blind assembly of this embodiment, when the bobbin 266 is rotated by the actuator cord 140' and resisted by the constant tension spring 269, the spur gear 272 is rotated by the gear assembly 240' which in turn causes the mounting disc to rotate. The mounting disc is releasably connected to the mounting bracket 280, however, and as long as the bead 358 is seated in the detent 364, the disc 274 and bracket remain in a fixed relationship. Of course, the bobbin is trying to rotate the disc, but since the disc does not rotate relative to the fixed bracket, the headrail 105' is caused to rotate in reaction thereto thereby tilting the headrail between first and second closed positions wherein the transverse direction of the headrail is substantially vertical and parallel to the architectural opening in which it is mounted. Of course, the headrail can be stopped at any position between the two closed extremes and, for example, one position would be a fully open position wherein the headrail and consequently the supported slats in the covering are horizontally disposed and perpendicular to the architectural opening.

Typically, the limits of pivotal movement of the headrail 105' can be controlled by the amount of cord 140' wrapped on the bobbin 266 so that when the headrail reaches one of the extreme closed positions, rotation is stopped because the actuator cord has been fully unwrapped from or wrapped onto the bobbin. However, should the system be improperly threaded such that an operator may continue to pull on the actuator cord and force continued pivotal movement of the headrail, which is inhibited by its abutment with an adjacent depending slat 130', damage to the system is avoided because the bead 358 on the mounting disc 274 will snap out of the detent 364 thereby allowing the mounting disc and the bobbin 266 to continue to rotate, but now, relative to the bracket. Of course, to reset the system, the bead is simply repositioned in the detent to releasably fix the disc relative to the bracket.

While the axis of the disc 274 remains fixed relative to the bracket 280, the bead 358 is allowed to separate from the detent 364 as the arcuate slot 354 formed in the mounting disc permits a slight inward flex (FIG. 17) of the bead and thus the body of the disc. Conversely, when the bead is again aligned with the detent, a resiliency inherent in the mounting disc forces the bead back into the detent. It will be appreciated that the material from which the mounting disc is made needs to have some resiliency and many plastic materials are suitable.

Although the present invention has been described with a certain degree of particularity, it is understood that the disclosure has been made by way of example, and changes in detail or structure may be made without departing from the spirit of the invention as defined in the appended claims.

What is claimed is:

1. A covering for an architectural opening comprising in combination, a headrail supporting a plurality of ladder cords, a plurality of slats supported on said ladder cords, a tilt mechanism on said headrail for manipulating said ladder cords to pivot said slats between an open position wherein the slats are substantially perpendicular to said architectural opening and first and second closed positions wherein said slats are substantially parallel with said architectural opening, said tilt mechanism including a weight and an actuator cord attached thereto, a rotatable bobbin around which said cord can be selectively wrapped to bias said bobbin in a first rotative direction, a counterbalancing system operative on said bobbin to bias said bobbin in an opposite rotative direction, and a system operatively connected to said bobbin to move said slats between said first and second closed positions upon rotation of said bobbin.

2. The covering of claim 1 wherein said counterbalancing system is a spring.

3. The covering of claim 1 wherein said bobbin is elongated along the direction of its axis of rotation and is of varying radius from said axis along its length such that the bias on said bobbin effected by said weight and actuator cord varies with the number of wraps of the cord around said bobbin.

4. The covering of claim 1, 2 or 3 wherein the bias applied to said bobbin by said counterbalancing system is variable with the rotative position of said bobbin.

5. The covering of claim 1, 2 or 3 further including a bracket for mounting said covering in said opening and wherein said bracket defines an axis about which said headrail can pivot, a fixed gear mounted on said axis, and a gear system operatively interconnecting said bobbin to said fixed gear, said gear system rotating in response to rotation of said bobbin to cause said headrail to pivot as said bobbin rotates.

6. The covering of claim 5 wherein said ladder cords are supported from said headrail so as to shift positions with pivotal movement of said headrail, said shifting of positions of said ladder cords causing said slats to pivot in unison with said headrail.

7. The covering of claim 5 wherein said gear system includes a first gear for unitary rotation with said bobbin and a second gear operatively connected to said first gear and said fixed gear such that rotation of said bobbin causes said second gear to roll around said fixed gear to effect pivotal movement of said headrail.

8. The covering of claim 6 wherein said gear system includes a first gear for unitary rotation with said bobbin and a second gear operatively connected to said first gear and said fixed gear such that rotation of said bobbin causes said second gear to roll around said fixed gear to effect pivotal movement of said headrail.

9. The covering of claim 5 wherein said counterbalancing system is a spring, said bobbin includes a shaft for unitary rotation therewith and wherein said spring is operatively connected to said shaft such that rotation of said shaft varies the bias placed on said bobbin by said spring.

10. The covering of claim 3 further including a housing for said tilt mechanism, said housing including a slot through which said actuator cord passes prior to being wrapped around said bobbin, said slot being contoured to substantially follow the varying radius of said bobbin such that said actuator is fed onto said bobbin at substantially the same angle regardless of the radius of the bobbin at the location where the cord is wound thereon.

11. The covering of claim 9 wherein said headrail is hollow and said housing is positioned in the hollow of said headrail.

* * * * *